United States Patent [19]

Kazahaya

[11] Patent Number: 4,794,372

[45] Date of Patent: Dec. 27, 1988

[54] TWO-WIRE DC SIGNAL TELEMETERING SYSTEM

[75] Inventor: Masahiro Kazahaya, Southampton, Pa.

[73] Assignee: Fischer & Porter Co., Warminster, Pa.

[21] Appl. No.: 88,561

[22] Filed: Aug. 24, 1987

[51] Int. Cl.[4] ..... G08B 21/00

[52] U.S. Cl. ..... 340/870.16; 340/310 A; 340/870.39

[58] Field of Search ..... 340/870.39, 310 A, 310 R, 340/870.16

[56] References Cited

U.S. PATENT DOCUMENTS

| | | | |
|---|---|---|---|
| 4,520,488 | 5/1985 | Houvig et al. | 340/310 R |
| 4,604,566 | 8/1986 | Sterling, Jr. et al. | 340/870.39 |
| 4,607,247 | 8/1986 | Sterling, Jr. et al. | 340/870.39 |
| 4,691,328 | 9/1987 | Sterling, Jr. et al. | 340/310 R |

*Primary Examiner*—John W. Caldwell, Sr.
*Assistant Examiner*—Tyrone Queen
*Attorney, Agent, or Firm*—Michael Ebert

[57] ABSTRACT

A telemetering system wherein a transmitting device responsive to an input signal derived from a sensor representing a metered variable, such as temperature or flow rate, is adapted to generate a corresponding direct-current signal. This signal is conveyed over a two-wire line to a receiving station through a terminal resistor across which a voltage signal is developed corresponding to the incoming current signal. The receiving station includes a DC power supply whose output is fed over the same two-wire line to the transmitting device to provide operating power therefor. In order to enhance the power available to the transmitting device, the current signal generated by the transmitting device lies in a 0% to 100% signal range in which the ratio of direct-current $I_o$ at 0% signal to direct-current $I_{100}$ at 100% signal is greater than 1/5 or 0.2. However, the voltage signal developed across the terminal resistor corresponds to the current signal and is converted to yield an output voltage signal in a 0% to 100% range in which the ratio of voltage $V_o$ at 0% signal to voltage $V_{100}$ at 100% signal is equal to 1/5 or 0.2, thereby making it possible at the receiving station to operate receivers such as controllers and recorders which respond to an input voltage signal of this type.

5 Claims, 1 Drawing Sheet

TWO-WIRE DC SIGNAL TELEMETERING SYSTEM

BACKGROUND OF INVENTION

1. Field of Invention

This invention relates generally to a two-wire telemetering system in which a direct-current signal generated by a transmitting device is conveyed over a two-wire line to a receiving station having a DC power supply whose output is supplied to the transmitting device over the same line to provide operating power therefor, and more particularly to a system of this type capable of supplying a relatively large amount of power to the transmitting device.

2. Status of Prior Art

A two-wire telemetering system is useful in an industrial process control loop in which a value sensed at a transmitting device by a thermocouple or other sensor of the process variable being metered is converted into a direct current signal that is conveyed over a two-wire line to a remote receiving station for operating indicators, recorders or controllers in the process control loop.

One important advantage of a two-wire telemetering system of this type is that the same wires serve not only to convey the current signal from the transmitting device to the station but also to conduct operating power from the receiving station to the transmitting device. The dual use of the power supply line as the signal line obviates the need for extra wires in remote control measurement. Also, a current output minimizes susceptibility to voltage noise spikes and eliminates line drop problems.

For such a telemetering system, American National Standard ANSI-MC 12.1-1975 and ISA-S 50.1, "Compatibility of Analog Signals for Electronic Industrial Process Instruments" specify that the standard output signal (of a transmitting device) shall be of a constant current nature having a range of 4 mA to 20 mAdc [Section 3.2 of the Standard], and that the standard voltage signal (of the receiver) shall be 1 volt to 5 volt dc [Section 3.3.2 of the Standard]. These standards are generally accepted and practiced by the industrial process control industry. Hence in most industrial process control instruments, 4 mAdc is assigned to the direct-current $I_0$ at 0% signal and 20 mAdc to the direct-current $I_{100}$ at 100% signal.

Thus the direct-current signal generated by the transmitting device lies in a 0% to 100% signal range in which the ratio of current $I_0$ (=4 mA) at 0% signal to current $I_{100}$ (=20mA) at 100% signal is equal to 1/5 or 0.2. At the receiving station, this current signal flows through a terminal resistor to produce a voltage signal thereacross of 1 to 5 volts whose ratio of voltage $V_0$ at 0% to the voltage $V_{100}$ at 100% is equal to 1/5 or 0.2.

It has been found that known telemetering systems of this type fail in some instances to supply adequate operating power for transmitting devices. For example, if the transmitting device is a differential-pressure (D-P) transducer operating in conjunction with a square root extractor, the power demand of the D-P transducer and the associated square root extractor are not satisfied at low input levels when the device operates in the usual 4 to 20 mAdc range. And if one wishes to include a microprocessor in a transmitting device, because of the existing constraints in power availability, this may not be possible.

By reason of this power limitation, it becomes necessary in many instances to operate the telemetering system in a four-wire configuration rather than with a two-wire line. The additional wires are required to convey adequate operating power to the transmitting device, thereby losing the important benefits of a two-wire system.

SUMMARY OF INVENTION

In view of the foregoing, the main object of this invention is to provide a two-wire telemetering system wherein the same line conducts a direct-current signal from a field station transmitting device to a receiving station which supplies operating power over this line to the transmitting device, the amount of operating power supplied being sufficient even at low signal levels to energize relatively complex transmitting devices such as magnetic flowmeters, field-mounted multiplexers and microprocessor-based transmitting devices.

More particularly, an object of the present invention is to provide a two-wire telemetering system of the above type in which the amount of power supplied to the transmitting device is enhanced by causing the device to operate with a current signal far higher than 4 mA at 0% signal, whereby the ratio of minimim current $I_0$ to maximum current $I_{100}$ in the range is substantially greater than ratios heretofore used.

Also an object of the invention is to provide a two-wire telemetering system of the above type which is of relatively simple, low cost construction, yet operates efficiently and reliably.

Briefly stated, these objects are attained in a telemetering system wherein a transmitting device responsive to an analog voltage derived from a sensor representing a metered variable, such as flow rate, is adapted to generate a corresponding direct-current signal. This signal is conveyed over a two-wire line to a receiving station through a terminal resistor across which a voltage signal is developed corresponding to the incoming current signal. The receiving station includes a DC power supply whose output is fed over the same two-wire line to the transmitting device to provide operating power therefor.

In order to enhance the power available for this purpose, the current signal generated by the transmitter lies in a 0% to 100% signal range in which the ratio of current $I_0$ at 0% signal to current $I_{100}$ at 100% signal is greater than 1/5 or 0.2. However, the voltage signal developed across the terminal resistor corresponds to the current signal and is converted to yield an output voltage signal in a 0% to 100% range in which the ratio of voltage $V_0$ at 0% signal to voltage $V_{100}$ at 100% signal is equal to 1/5 or 0.2, thereby making it possible at the receiving station to operate receivers which respond to an input voltage signal of this type.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Prior Art System

Figure 1:
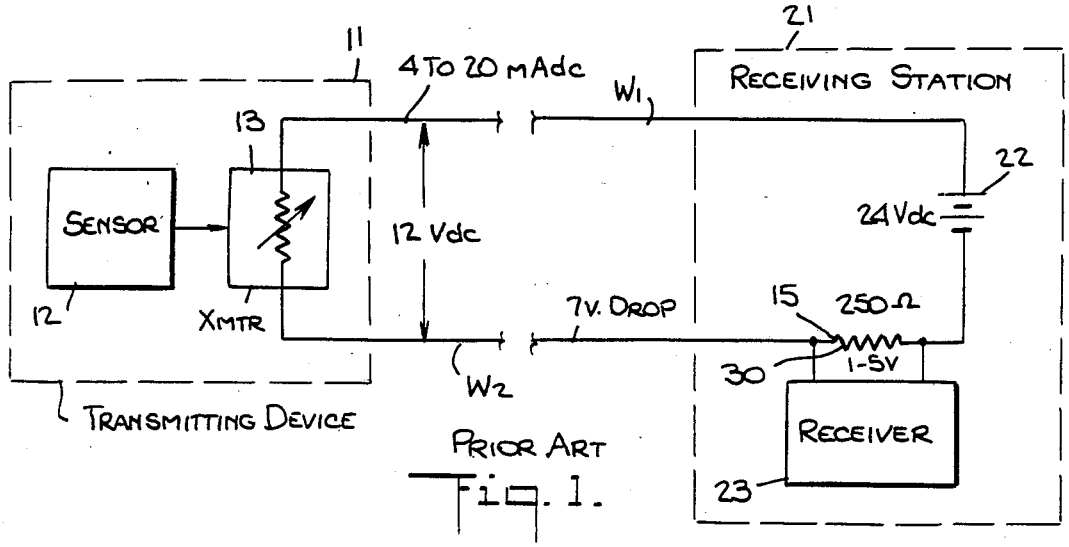
PRIOR ART Fig. 1.
FIG. 1 is a schematic diagram of a prior art two-wire telemetering system.

In order to illustrate the power deficiency problem encountered with a known type two-wire telemetering system, FIG. 1 shows the basic elements of this system which includes a transmitting device 11 coupled by a line having two wires $W_1$ and $W_2$ to a remote receiving station 21.

At transmitting device 11, a sensor 12 is provided, which may be a thermocouple or any other field-mounted element responsive to a process variable. The variable being metered may be fluid temperature, flow rate, or fluid pressure to produce an analog signal proportional thereto. The analog signal yielded by sensor 12 is applied to a transmitter 13 which serves to convert the analog signal to a current signal in the 4 to 20 mAdc range.

Receiving station 21 is provided with a DC power supply 14 which typically provides a 24 Vdc output. This supply is connected to wires $W_1$ and $W_2$ of the line leading to transmitting device 11 through a terminal resistor 30. This typically has a value of 250 ohms according to the above-noted Standard. The resultant voltage developed across terminal resistor 30 lies in a 1 to 5 Vdc range, thereby converting the 4 to 20 mA input signal from the transmitting device to a corresponding voltage signal in a range having the same ratio. The voltage developed across terminal resistor 30 is applied to a receiver 23, such as a controller, indicator or recorder.

The reason why it is necessary to convert the current signal transmitted from the transmitting device 11 to a corresponding voltage signal is that receiver 23 is generally of the 1 to 5 Vdc input type, not of the current input type.

The typical maximum voltage drop encountered in the two-wire line is 7 Vdc at full scale (20 mAdc). The terminal voltage of the transmitter is typically 12 Vdc. In a conventional two-wire telemetering system of the type illustrated, intrinsic safe circuits, lightning protectors and the like are provided having a capacity to handle 20 mAdc; hence these circuits also operate effectively throughout the 4 to 20 mAdc range.

A system in accordance with the invention, as will later be explained, operates in a current signal range whose maximum signal level is 20 mAdc, and it yields at the receiving station an output voltage signal in a range of 1 to 5 Vdc. Hence this new system is compatible with existing systems. The fact that the current signal range in a system in accordance with the invention has a zero signal level that is well above the conventional 4 mAdc level does not render the new system in any way incompatible with known systems.

The Transmitter

Figure 2:
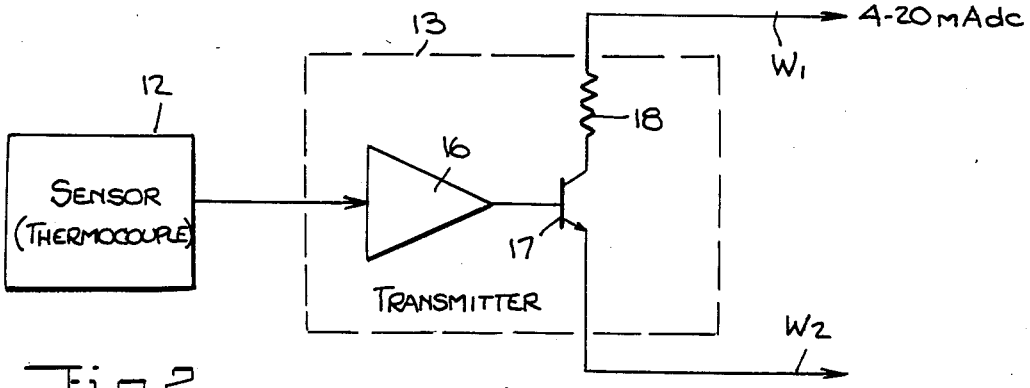
FIG. 2 schematically illustrates a typical transmitter in a system of this type.

In order to explain how transmitter 13 acts to convert the analog voltage from sensor 12 to a corresponding current signal, reference is now made to FIG. 2. It will be seen that in transmitter 13, the analog voltage from sensor 12 is fed to an amplifier 16, the output of which is applied to an output transistor 17 whose load is a resistor 18.

Amplifier 16 is a voltage amplifier, and its power consumption remains unchanged between zero and full scale of the current transmission signal. Hence transmitter 13 is basically designed to operate with a 4 mAdc power supply; that is, at the zero signal level in the current signal scale.

When transmitter 13 generates a 20 mAdc maximum scale signal, then 16 mA (20 mA–4 mA) is consumed by transistor 17 and resistor 18, roughly speaking. If, therefore, it were possible to provide an increase in milliamperes at the zero signal level in the current range, then more electric power would become available to operate transmitter 13 and sensor 12 associated therewith.

This additional power makes it feasible in a two-wire telmmetering system to fully power a D-P transducer wihh a square root extractor, a thermocouple multiplexer, or other instrument for which adequate power is usually lacking in a conventional 4 to 20 mAdc two-wire system because at low signal current levels the resultant power is insufficient. And if in FIG. 2 amplifier 16 in the transmitter is replaced by a circuit that includes a microprocessor, the additional power will be sufficient to operate this transmitter.

The New Two-Wire System

In order to provide enhanced power, in a system in accordance with the invention the current signal produced by the transmitter is not in a signal ratio ($I_0/I_{100}$) of 1/5 such as 4 to 20 mAdc as in prior art systems, but in a ratio significantly higher than 1/5, such as 18 to 20 mAdc. Because the zero current signal level is 18 mAdc, much more operating power is then available for the transmitting device 11. On the other hand, it is important to provide an output voltage signal of 1 to 5 volts or in a range whose ratio is 1/5 as in prior systems in order to operate the receivers that are commercially available.

Figure 3:
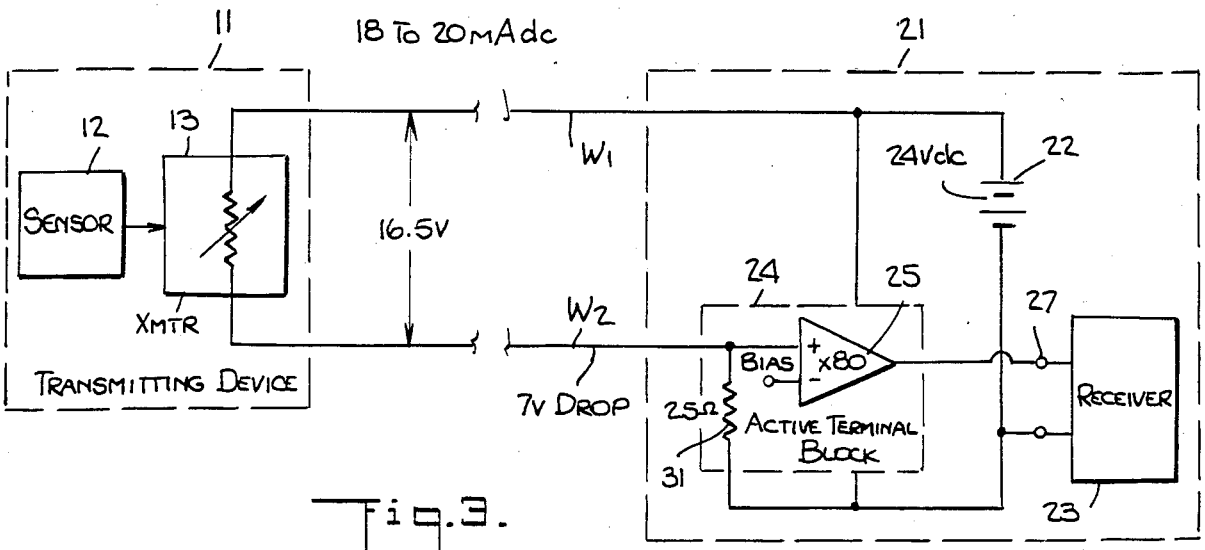
FIG. 3 schematically illustrates a two-wire telemetering system in accordance with the invention.

FIG. 3 shows a system in accordance with the invention in which transmitting device 11 produces a current signal in the 18 to 20 mAdc range; hence a signal in which the ratio of current $I_0$ at 0% to current $I_{100}$ at 100% in the current signal range is much greater than 1/5 or 0.2, the system yielding at the receiving station a voltage signal in the 1 to 5 V range; hence having the required 1/5 ratio or 0.2.

Since the $I_0/I_{100}$ ratio of the compatible 18–20 mAdc system is 18/20 or 0.9 and does not match the conventional 1/5 or 0.2 ratio, an active terminal block 24 is required at receiving station 21 to convert the incoming 18 to 20 mAdc current signal into a 1 to 5 Vdc signal for operating a receiver 23.

Active terminal block 24 is provided with a terminal resistor 31 which is connected in series with DC power supply 22 and transmission line $W_1$, $W_2$ leading to transmitter 13 in transmitting device 11. Hence the 18 to 20 mA signal from the transmitter flows through resistor 31. This resistor has a value of only 25 ohms to develop thereacross a corresponding voltage signal in the 0.45 to 0.5 Vdc range.

This voltage signal is applied to an input of an operational amplifier 25 to whose other input is applied a bias voltage of 0.4375 Vdc. The gain of operational amplifier 25 is 80, so that yielded in the output thereof at terminals 27 is the required 1 to 5 Vdc signal to operate receiver 23. The conversion of the 0.45 Vdc to 0.5 Vdc range to the 1 Vdc to 5 Vdc range can be seen as (0.45 V–0.4375 V)×80=1V and (0.5 V–0.4375 V) ×80=5 V.

In this embodiment of the invention, power source 22 has a 24 voltage output, and the line voltage drop is 7

Vdc, as in prior art systems. The maximum active terminal block operating voltage is 0.5 Vdc. However, because of the 18 to 20 mAdc operating range of the transmitter, the available terminal voltage at the transmitting device 11 is now 16.5 Vdc. This voltage magnitude is much higher than the 12 Vdc available in prior art 4 to 20 mAdc systems.

In a system in accordance with the invention, available at transmitting device 11 with a zero signal of 18 mAdc is a power of 0.30 watts. This is 6.2 times higher than the power produced with a conventional system which at a zero signal of 4 mAdc with an available terminal voltage of 12 V dc results in only 0.048 watts of power.

While there has been shown and described a preferred embodiment of a two-wire DC signal telemetering system in accordance with the invention, it will be appreciated that many changes and modifications may be made therein without, however, departing from the essential spirit thereof.

I claim:

1. A telemetering system for conveying over a two-wire line both a direct-current signal representing a process variable and operating power, said system comprising:

(A) a transmitting device provided with a transmitter connected to said line, which transmitter in response to an input voltage representing a metered variable generates a corresponding direct-current signal in a direct-current signal range whose lowest value is a current $I_o$ and whose highest value is a current $I_{100}$, in which current $I_o$ at a 0% signal generated by the transmitter has a ratio to current $I_{100}$ at a 100% signal generated by the transmitter that substantially exceeds 1/5;

(B) a receiving station provided with a DC voltage source connected to said line through a terminal resistor whereby developed across the resistor is an output voltage corresponding to said direct-current signal, said source supplying operating power to said transmitting device through said line; and (C) means at said receiving station to convert said output voltage to a corrected output voltage in a range whose lowest value is a voltage $V_o$ and whose highest value is a voltage $V_{100}$ in which voltage $V_o$ at said 0% signal has a ratio to voltage $V_{100}$ at said 100% signal that equals 1/5.

2. A telemetering system as set forth in claim 1, wherein $I_o$ is 18 mAdc and $I_{100}$ is 20 mAdc.

3. A telemetering system as set forth in claim 1, wherein $V_o$ is 1 Vdc and $V_{100}$ is 5 Vdc.

4. A system as set forth in claim 1, wherein said means is constituted by an operational amplifier having two inputs, one input of which has applied thereto the output voltage developed across said terminal resistor, a fixed bias voltage being applied to the other input, said amplifier having a gain producing said output voltage.

5. A system as set forth in claim 1, in which said direct current signal is derived from a sensor responsive to a process variable, said sensor being powered by said source.

* * * * *